US005275301A

United States Patent [19]

Clive-Smith

[11] Patent Number: 5,275,301

[45] Date of Patent: Jan. 4, 1994

[54] COLLAPSIBLE FREIGHT CONTAINER WITH GATES

[76] Inventor: Martin Clive-Smith, 66 Leam Terrace, Leamington Spa CV31 1BO, England

[21] Appl. No.: 33,017

[22] Filed: Mar. 18, 1993

[30] Foreign Application Priority Data

Mar. 18, 1992 [GB] United Kingdom ..... 9205878
Apr. 24, 1992 [GB] United Kingdom ..... 9208958

[51] Int. Cl.[5] ..... B65D 6/18; B65D 6/22

[52] U.S. Cl. ..... 220/1.5; 220/6; 206/504

[58] Field of Search ..... 220/6, 1.5, 23.4, 23.6, 220/23.2, 666, 668, 4.29; 206/509, 504, 512

[56] References Cited

U.S. PATENT DOCUMENTS 3,480,174 11/1969 Sherwood ..... 220/1.5
3,591,033 7/1971 Askham ..... 220/6
3,646,609 2/1972 Bodenheimer ..... 220/1.5
4,099,640 7/1978 Nessfield et al. ..... 220/6
4,650,381 3/1987 Durkin ..... 206/512
4,911,318 3/1990 Bishop ..... 220/1.5

FOREIGN PATENT DOCUMENTS 2170185 7/1986 United Kingdom ..... 220/1.5

*Primary Examiner*—Allan N. Shoap
*Assistant Examiner*—S. Castellano
*Attorney, Agent, or Firm*—Ware, Fressola, Van Der Sluys & Adolphson

[57] ABSTRACT

A freight container of the flatrack type is designed to have an end wall structure 22 plus inboard from the end wall structure a gate 23 which is pivotally or collapsibly mounted thereon. The gate 23 includes a load bearing post having a freight container-securing fitment 26 of conventional type, these fitments 26 being positioned at the standard positions for such fitments in a standard freight container but the platform 21 being extended beyond these positions to carry additional load. Diagonal bracing 29 and diagonal top links 37 triangulate and rigidify the gate structure against longitudinal, lateral and vertical forces in both tension and compression.

15 Claims, 10 Drawing Sheets

PRIOR ART

COLLAPSIBLE FREIGHT CONTAINER WITH GATES

BACKGROUND OF THE INVENTION

1. Fields of the Invention

This invention relates to freight containers. It particularly relates to the type of freight container called a platform based container or flatrack.

Freight containers have long been standardised so as to facilitate international trade. This means that the associated handling and transport devices have also been standardised. In particular, the exact location and spacing of the stacking points and lifting points of the containers have been standardised and so cranes, stacking trucks, vehicles and so on have been built to accept the container having such standardised fitments.

Recently, a move has been made towards using longer, taller and wider containers, particularly on inland routes, to optimise cargo carrying efficiency.

For a rigid freight container, all that is necessary is to provide the lifting and fixing points at the standard positions, extending the container structure outside the standard dimensions as required. However this cannot be done readily with platform based containers known as flatracks.

2. Description of the Prior Art

Flatracks comprise a platform on which a load is carried and a pair of end walls which, during transit of freight, are locked in an upright condition so as to define the freight carrying space together with the platform. When the freight has been unloaded, the end walls are stowed relative to the platform so that a number of flatracks can be stacked and returned empty. Since the structure is intrinsically lighter than a rigid walled container and since it can be folded into a compact space, substantial economies can be achieved in the use of flatracks compared with rigid containers.

However, the move towards making containers longer has not hitherto been successful in connection with flatracks because the lifting and stacking formations are provided on the end walls. While it would be desirable to extend the platform and to provide lifting and stacking formations inboard of the end walls, no satisfactory means has hitherto been suggested for doing this, bearing in mind that any upright structures on the flatrack need to be fully stowable with respect to the platform.

BRIEF SUMMARY OF THE INVENTION

It is an object of the invention to provide a flatrack or platform based freight container which overcomes or reduces this disadvantage.

According to the invention there is provided a platform based freight container comprising a rectangular platform having two end portions and four corner portions;

an end structure at each of said end portions adapted to be secured upright with respect to the platform in an in-use condition to define a freight-carrying space and adapted to be released from the upright, in-use condition to be stowed relative to the platform in a stowed condition;

the end structure defining corner articulation means;

a pair of gate means mounted in association with the end structure at said articulation means for deployment in an in-use condition in which the gate means extend along the platform from the corner portions thereof;

each gate means having at least one container-securing fitment at a position spaced inboard from the end of, and above the platform in said in-use condition;

and the gate means being releasable from the in-use condition to a stowage condition in which they are contigouus with the end structure in its stowed condition.

The articulation means may comprise upright pivots such that the gate means are pivotally mounted about an upright axis with respect to the end structure in the in-use condition.

At least one gate may pivot inwardly with respect to the platform to lie parallel to and within the end structure in the stowage condition.

Alternatively, at least one gate may pivot outwardly with respect to the platform to lie parallel to and outside the end structure in the stowage condition.

The end structure may be pivotally mounted to the end of the platform for movement to a stowed position overlying the end of the platform.

Further container-securing fitments may be provided on the end structure at said position spaced inboard from the platform in the stowed condition of the end structure.

The gate may be locked to the platform at a position directly below the container-securing fitment.

The lock may include a manually operated toggle linkage.

An articulation means may be provided at the foot of the endstructure and the gate means may include a diagonal brace extending from said articulation means to said container-securing fitment.

In an alternative embodiment, the articulation means may comprise horizontal pivots such that the gate means are collapsible towards the end structure.

In this case, an articulation means may be provided at the foot of the end structure and the gate means may include a diagonal brace extending from said articulation means to said container securing fitment, which may be releasable for collapsing of the gate means.

A generally horizontal diagonal link may be provided between the container securing fitment of each gate means and a central portion of the end structure spaced from the corner as seen in plan.

The diagonal link may be removable.

Alternatively the diagonal link may be releasable but captive to the gate. As a still further alternative, where the gate is pivoted about a vertical pivot, the diagonal link may be captive to said central portion of the end structure at a universal joint and releasably slidable relative to the gate.

BRIEF DESCRIPTION OF THE SEVERAL VIEWS OF THE DRAWINGS

The invention will be described in more detail by way of example only with reference to the accompanying drawings in which.

DETAILED DESCRIPTION OF THE PREFERRED EMBODIMENTS

Figure 1:
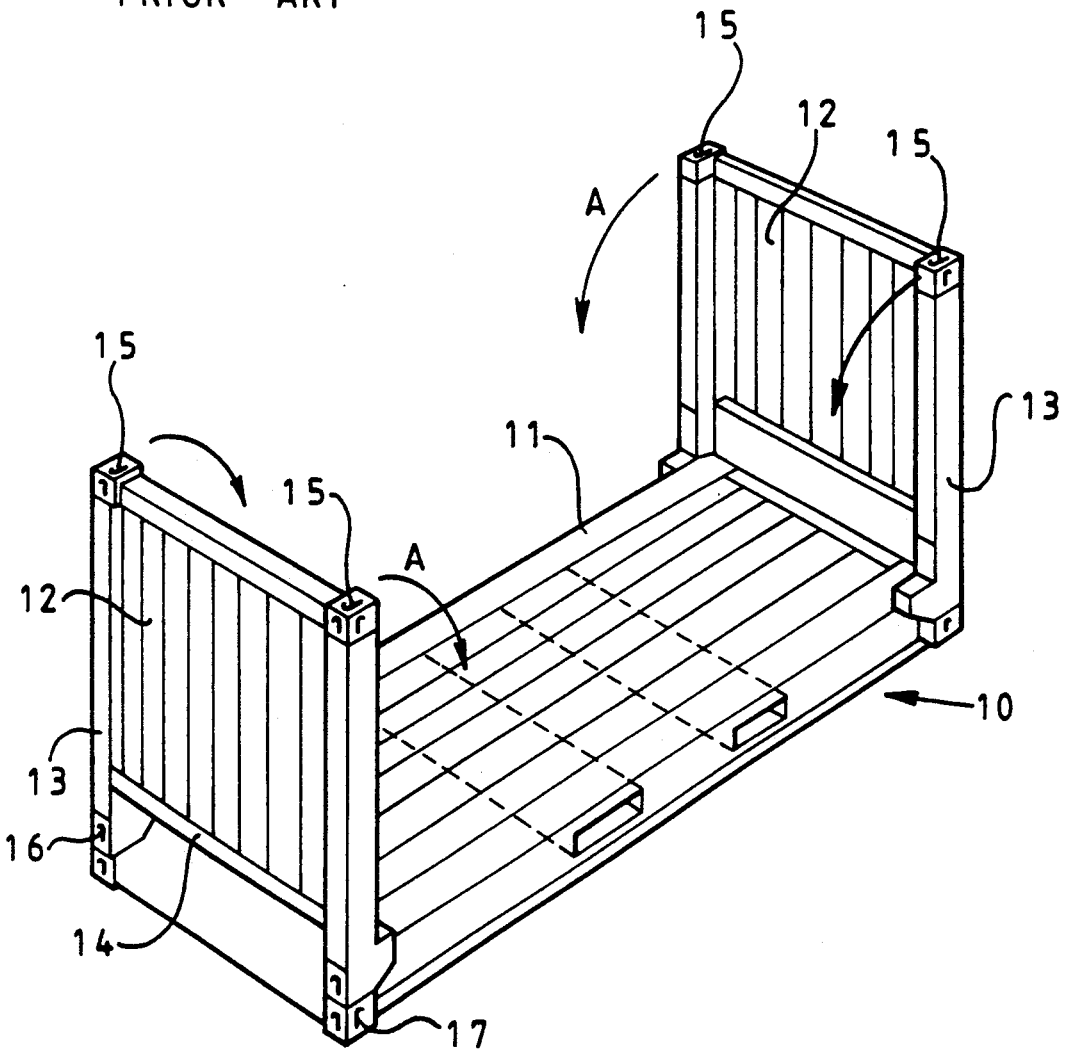
FIG. 1 is a perspective view of a prior art freight container.

FIG. 1 shows a prior art flatrack freight container for comparison purposes.

The freight container is generally indicated at 10 and comprises a rigid platform 11 and a pair of end structures 12. Each end structure comprises a pair of upright posts 13 and a cross member 14 which links them. At the top of the upright posts 13, which are positioned at the corners, there are conventional container securing fitments 15 of generally known type. The fitments are in the form of heavy rigid boxes having apertured sides which can receive lifting and securing means provided on other freight containers, on freight carrying vehicles, and on lifting apparatus such as cranes and forklift trucks. These fitments are of generally standard type and, in conventional freight handling apparatus and vehicles, they are spaced at conventional positions for which international standards apply. Thus, the exact spacing between the four fitments 15 of the prior art container is predetermined.

At the foot of each of the upright posts 13, a pivot (not shown in detail) is provided so that the end structure 12 can be folded down onto the platform 11 as illustrated by the arrows A. It is secured in the upright condition for normal use and is folded down for return transit when a number of freight containers can be stacked one on another and secured together in the space normally occupied by one container. For this reason further fitments of the generally standard type are provided at 16, which will be accessible at the top surface of the stowed container. Finally, still further fitments 17 are provided under the container at the corners of the platform 11 to secure it down to for example a carrying vehicle or to a similar container positioned below it. These fitments 17 are usable whether the end structures 12 are upright or stowed.

Referring now to FIGS. 2–5 of the drawings, there is shown an embodiment of freight container according to the present invention which enables the size of the platform 11 to be extended while retaining the positions of the main container securing fitments at the top of the container load space and at the below platform level.

To this end, the container which is generally indicated at 20 comprises a platform 21, an end structure which is generally indicated at 22 and a pair of side gates which are generally indicated at 23. As will be seen from FIG. 3 in particular, the gates 23 are arranged to extend along the platform 21 from the corners generally indicated at 24, of the end structure 22.

The gates each comprise a sturdy upright load supporting post 25 having a standard type of fitment 26 at its upper end. When the posts 25 are in the "in-use" condition shown in FIG. 2, the positioning of the fitments 26 is exactly the same as the standard positioning of the fitments 15 shown in FIG. 1. Thus, the container can be stacked with other standard containers and handled using standard handling equipment of a type which requires the fitments at this particular spacing. Similarly, on the platform 21, fitments 27 are provided to mate with another container or with a carrying vehicle at exactly the same positioning as the fitments 17 of the prior art container.

However in addition, at the extreme corners 24 of the platform, further fitments 28 are provided so that the extended platform can be mounted on for example an oversized freight car suitable for the purpose.

Figure 8:
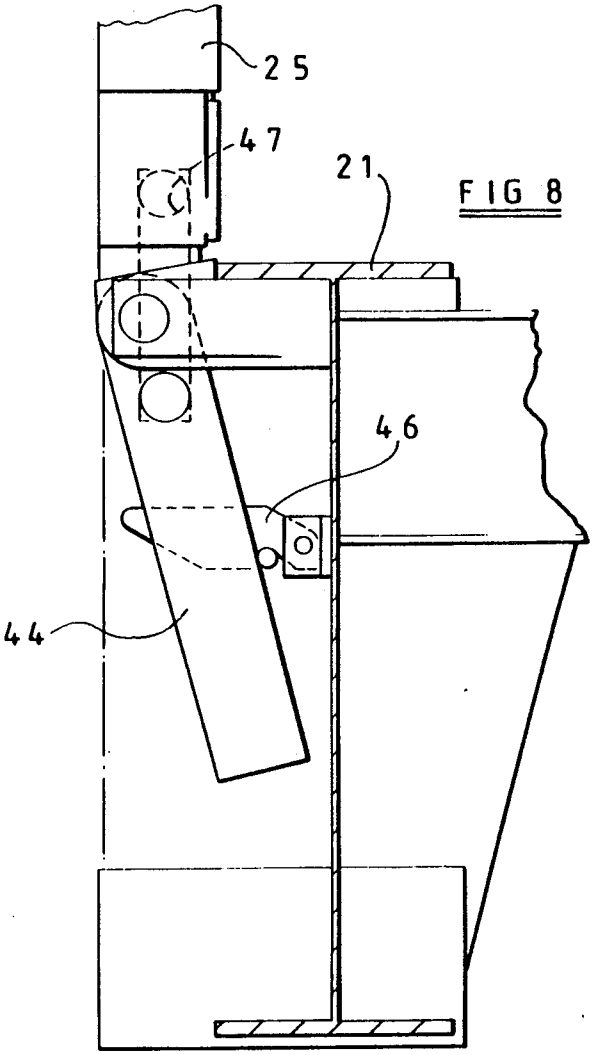
FIG. 8 is a sectional view illustrating the lock of FIG. 7.
Figure 7:
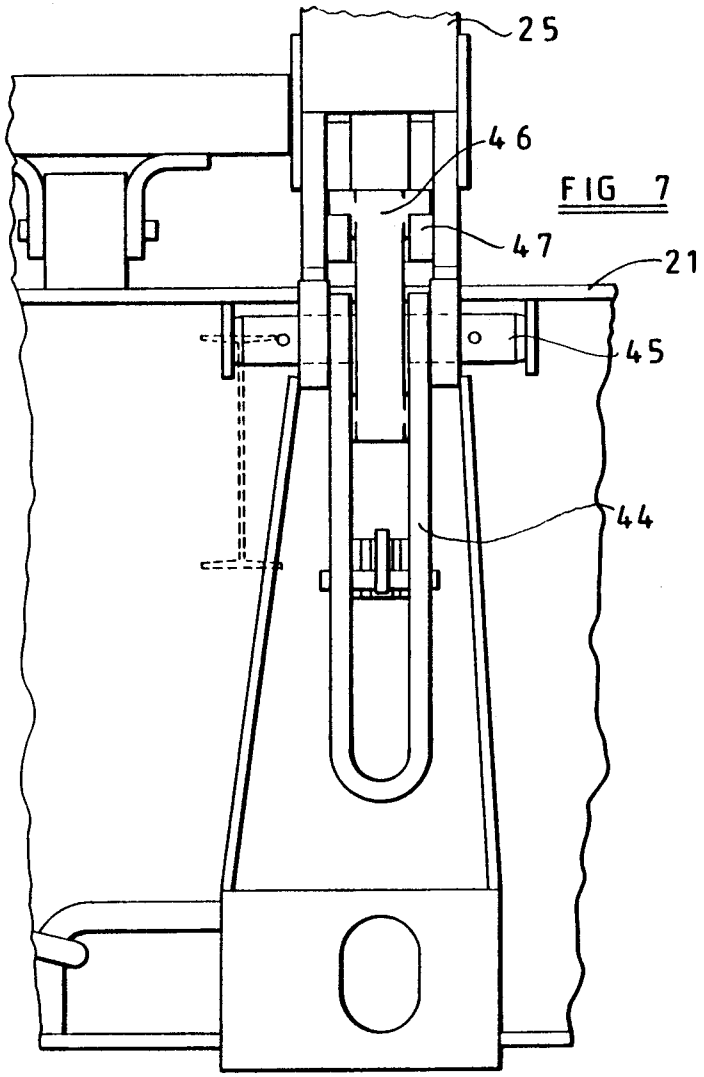
FIG. 7 is a scrap side elevational view of a lock forming part of a freight container embodying the invention.

The upright post 25 forming part of the gate 23 carries downward loads and bears directly on the platform to which it is secured by means to be described in relation to FIGS. 7 and 8. However in addition, it is necessary to brace the upright post 25 against forces acting generally longitudinally of the platform. This is done by means of a diagonal brace 29 which is secured at the top to the post 25 adjacent the fitment 26 and which is secured at the bottom to the corner 24 of the end structure 22. A tie rail 30 is provided to triangulate and rigidify the gate. It extends between the pivot 32 at the foot of the gate over to the foot of the upright post 25.

A similar top rail may be positioned at the top or may be omitted.

Figure 3:
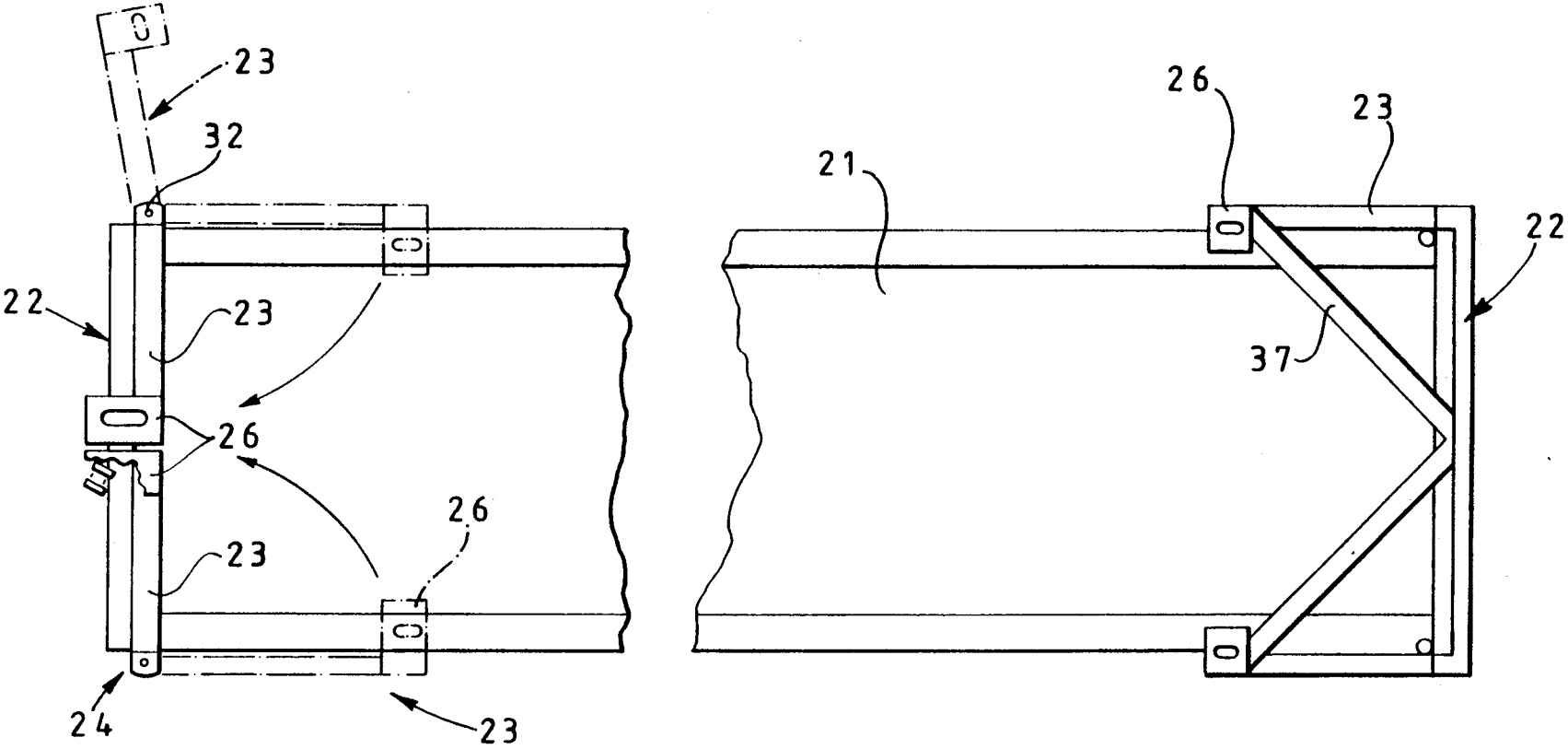
FIG. 3 is a plan view of the freight container of FIG. 2.
Figure 4:
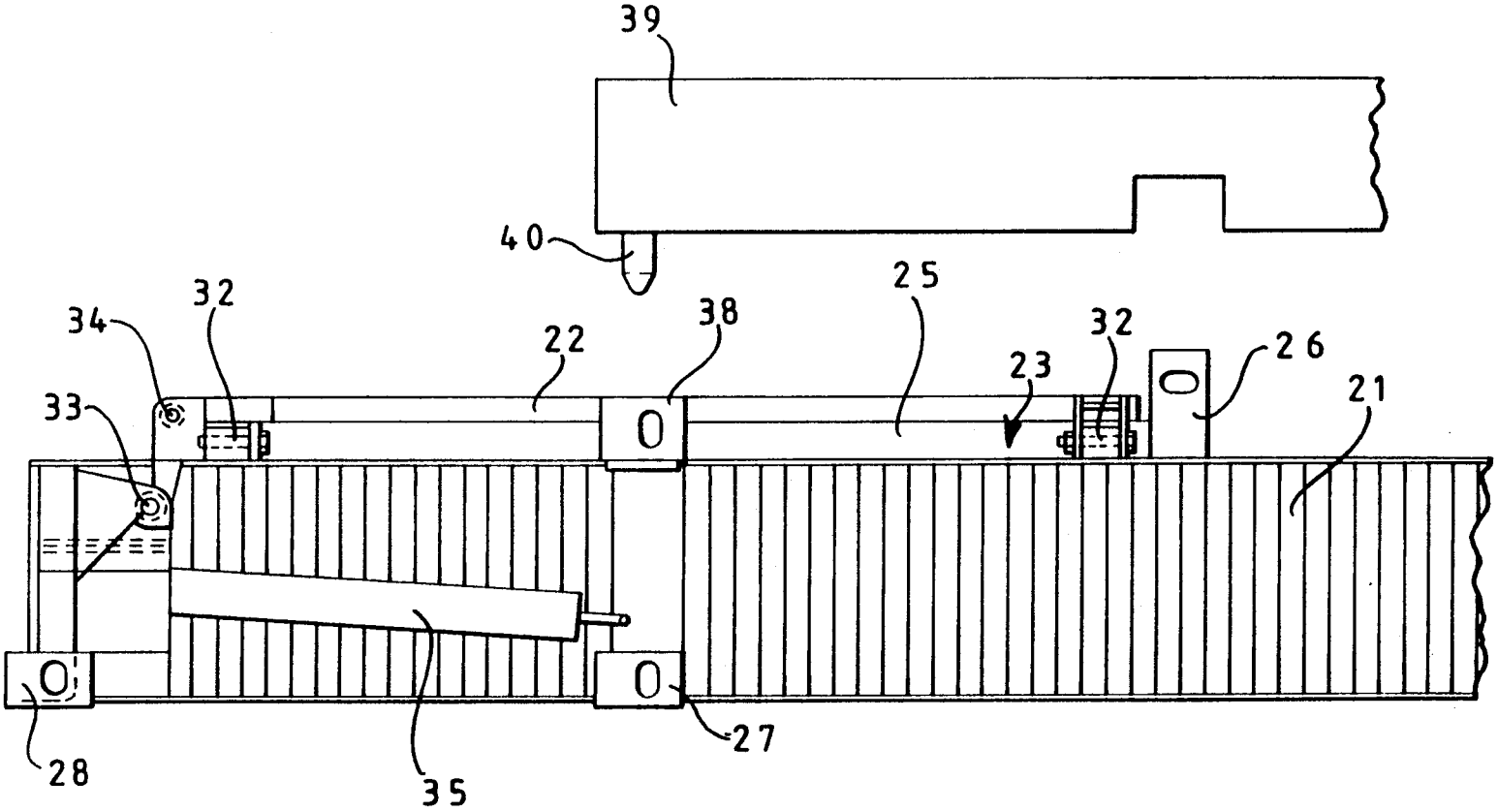
FIG. 4 is a view similar to FIG. 2 but showing the freight container in a stowed condition.

The gate 23 is pivoted to the end structure, in this case an end wall 22. The pivots 32 have a vertical axis when the end structure 22 is vertical and, as will be seen from consideration of the plan view in FIG. 3, each of the gates is half the width of the end structure so that the two gates can be folded inwardly on the arrows C to a condition where they are face to face with the end wall structure 22. Because the end wall structure is slightly lower than the gates, the fitments 26 can project over the top of the end wall structure. FIG. 3 also shows the gates 23 in their deployed condition and in a fully opened condition in which they are swung back from the pivots 32 to leave a completely free access at the sides of the freight container for loading purposes. The gates could be arranged to pivot completely round the back of the end structure 22 to abut it on the outside if desired.

In use, the gates are deployed in the in-use condition along the sides of the freight container so as to provide the fitments 26 at the correct centres for conventional handling apparatus. When it is desired to stack the empty freight container with others of the same type, the gate is swung into the condition shown in full lines in FIG. 3. The end structure 22 is then folded downwardly into a stowed condition in which it overlies the platform 21. This can be seen in FIG. 4 of the drawings.

The end structure 22 is arranged to be pivoted about a horizontal pivot pin 33 but is usually locked against such pivoting movement by a locking pin 34 which is spaced from the pivot 33. If the locking pin is withdrawn, the end structure 22 can be folded inwardly about the pivot 33 so as to overlie the platform 21. This is resisted by a resilient biasing means 35 such as a strong coiled tension spring acting on a lever arm 36 extending from the pivot 33. This enables the relatively heavy end structure, together with the gates folded into contiquity with it, to be lowered more easily.

Figure 2:
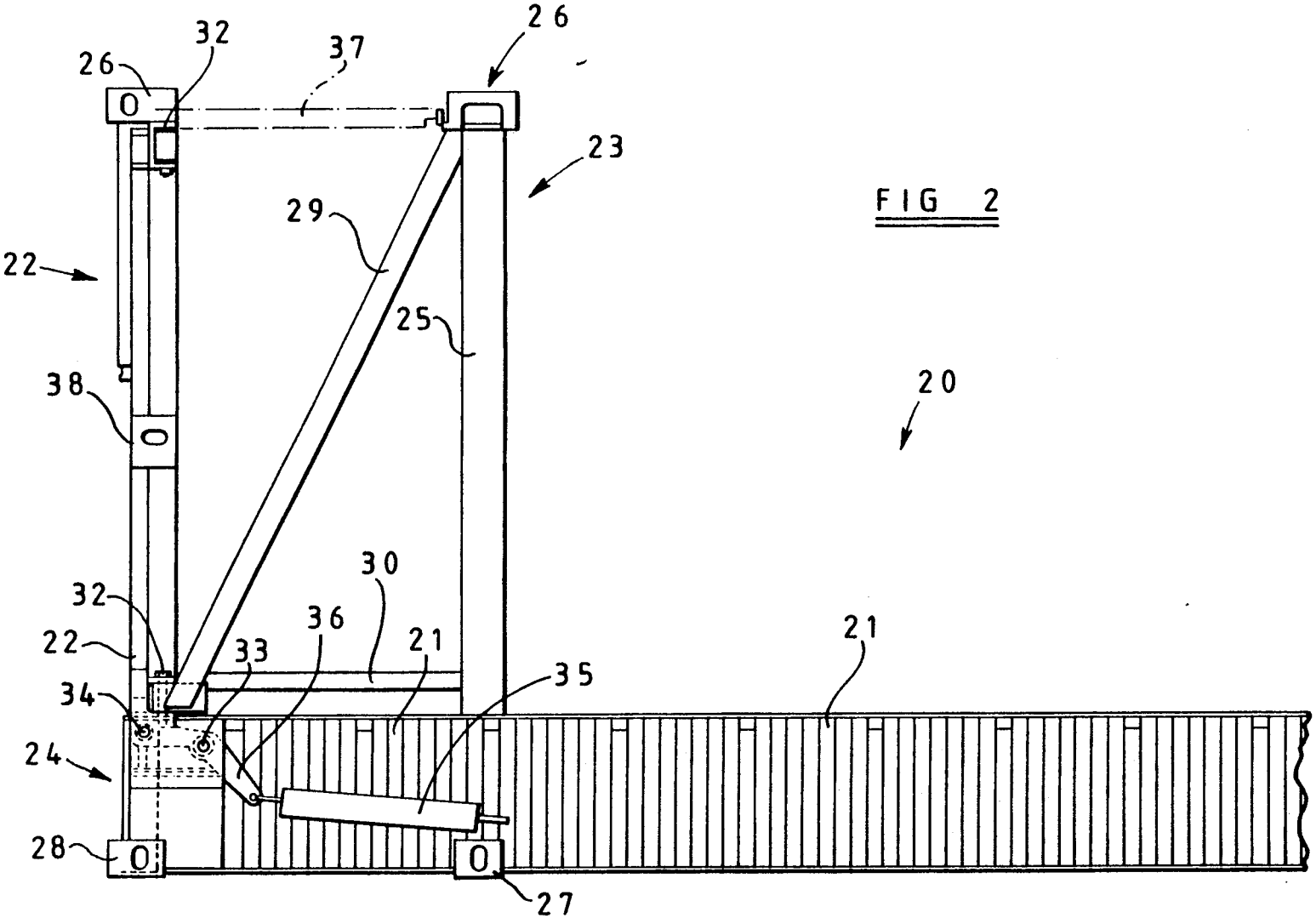
FIG. 2 is a side elevational view of part of a freight container embodying the invention.

Before this can be achieved, a further diagonal brace has to be opened. The diagonal brace is illustrated in FIG. 2 at 37 and may take various forms. However it links the top of the gate 23 at the fitment 26 with a central portion of the end wall structure 22. Similar diagonal braces are provided at each side of the container so that the gate is located against inward and outward movement in use.

The force loading on the fitment 26 whether in the vertical direction or in the horizontal longitudinal direction or in the horizontal lateral direction can be resolved into various components and these act along the diagonal braces 29 of the gates and the diagonal top links 37 so that the forces are spread through the end structure and gates and eventually to the strong rigid platform.

Thus, in order to stow the container, from the in-use condition, the top links 37 are firstly either removed or rendered inoperative and the gates 23 are released by a mechanism to be described from the platform. The gates can then be swung inwardly, to which end they may have castors running on a track on the platform for example or may simply swing inwardly on the pivots 32. When they are disposed flat against the end wall structure 22, the latter has its locking pin 34 released so that the end wall structure and gates can be swung downwardly against the biasing means 35 to lie on the platform. At this point, it is necessary for some fitments to be provided which are effective at the top surface of the stowed container. These fitments are shown at 38 part way up the end structure 22. When the end structure is folded down, they adopt exactly the same positions as the fitments 15 of a standard container and exactly overlie the underside fitments 27 on the platform. This can be seen from FIG. 4 of the drawings. A notional crane attachment is shown being lowered at 39 having twist locks 40. The fitment 26 tends to project somewhat upwardly in this condition and can usually be accommodated under handling apparatus such as cranes 39 or within the platform of a container stacked on top. However, otherwise, it can be arranged to be releasable and rotatable into alignment with the side gate as illustrated in chain-dotted lines at 41 in FIG. 5 or a suitable recess 42 can be provided in the platform 21 to receive the fully rotated fitment 26.

Figure 5:
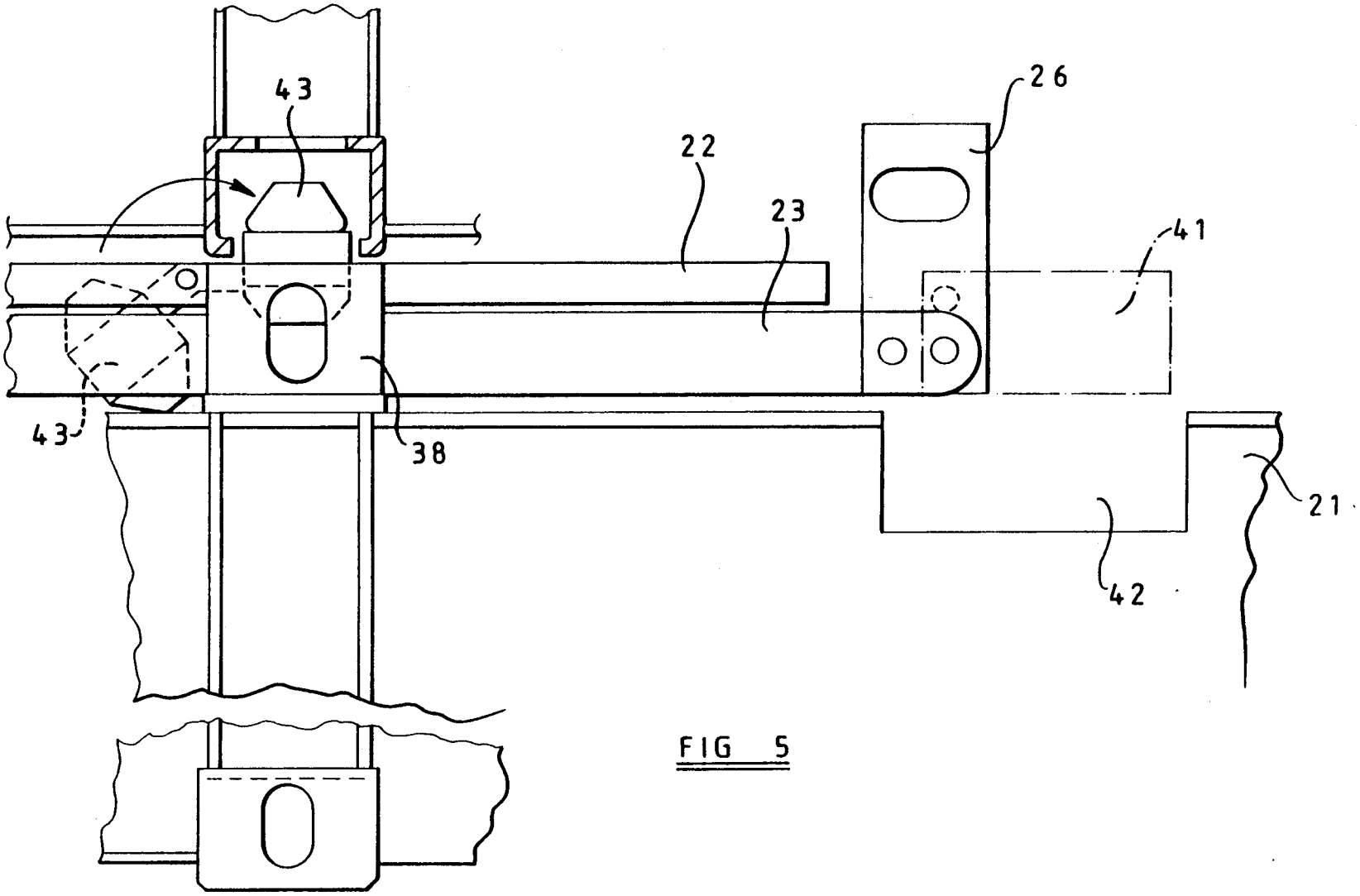
FIG. 5 is an enlarged detail view of the connection between a pair of freight containers similar to that of FIG. 4 stacked one on another.

The fitment 38 needs to have some means for connecting on a further container to be stacked on top in the stowed condition. This is achieved by providing a conventional twist lock 43 loosely pivoted within the end structure so as to be manually movable and operable once the end structure is in the horizontal stowed condition as illustrated in FIG. 5.

Reference will now be made to FIGS. 7 and 8 which illustrate the means for connecting the foot of the post 25 to the platform 21.

A manual handle 44 is pivotally mounted at 45 and, together with a T-shaped member 46 forms a toggle linkage which holds down a pair of cup-shaped plates 47 forming part of the foot of post 25. The toggle lever 44 is latched by means of a latch 46 which can be manually released, enabling the lever 44 to be swung outwardly of the side wall of the platform base, within which it is concealed in normal operation, actuating the toggle linkage and eventually releasing the headed T-shaped member 46 from the cupped side plates 47 to free the post 25. During normal use of the freight container, the toggle handle 44 is latched against inadvertent movement and is concealed within the side wall of the platform 21.

Figure 6:
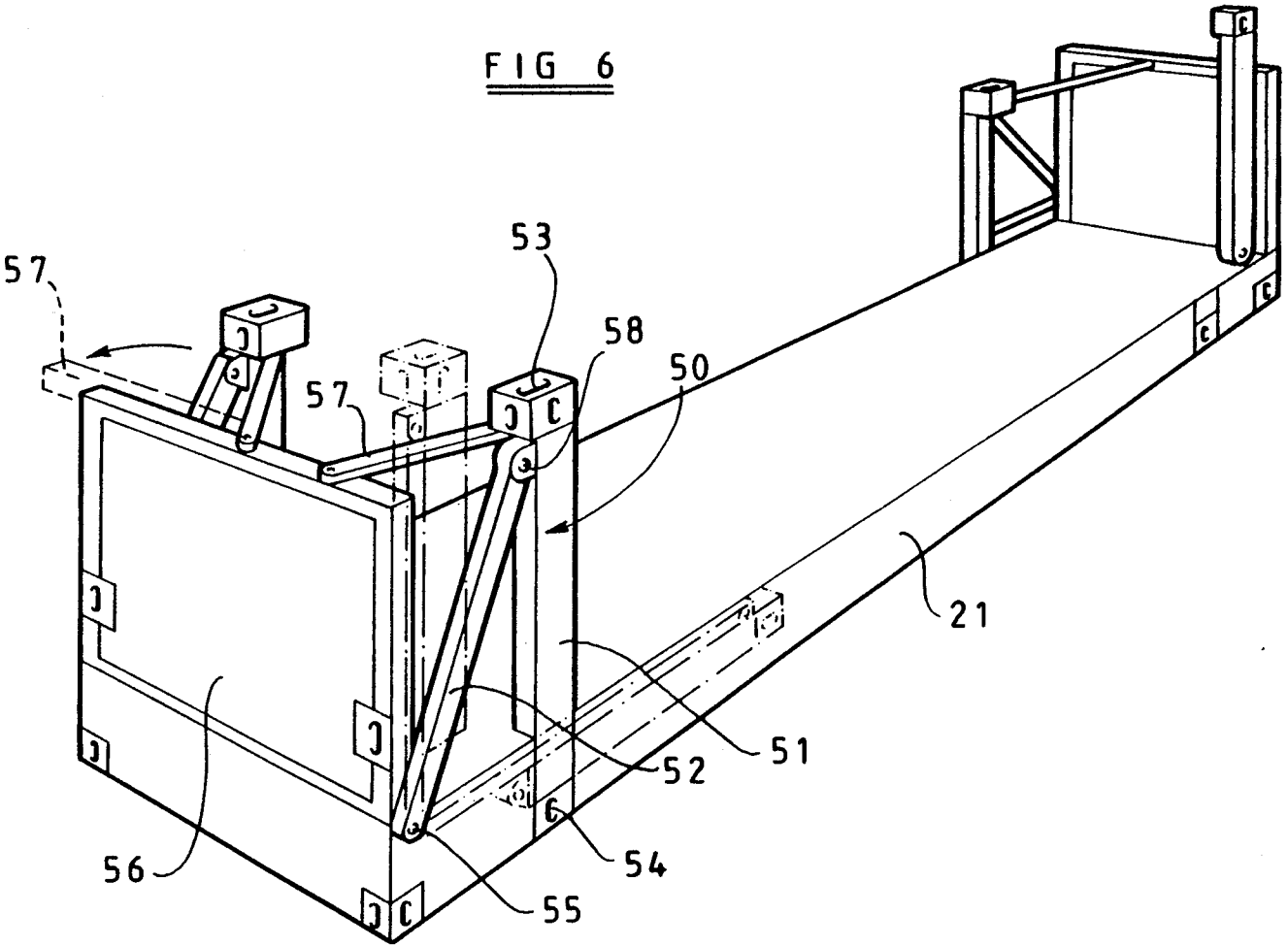
FIG. 6 is a perspective view of an alternative embodiment of freight container.

FIG. 6 of the drawings shown as alternative embodiment of container in which the pivoted gates 23 are substituted by collapsible gates 50. The gate 50 comprises an upright post 51 which is secured to the container platform 21 by the toggle latch means shown in FIGS. 7 and 8 for example. A diagonal brace 52 is pivotally secured to the top of the post 51 adjacent a standard container securing fitment 53 which, as previously described, is positioned at the same standard positions as the fitments 15 of FIG. 1. Similarly, standard fitments 54 are positioned below the upright posts 51 of the collapsible gates 50. The diagonal brace 52 is pivoted at 55 to the end structure 56. Diagonal top links 57 are also provided as previously described.

In order to collapse the gates 50, the top links 57 are firstly detached so that they no longer rigidify the gate structure 50. They can be detached either adjacent the fitments 53 as illustrated at the left-hand side of FIG. 6 so that they can be pivoted into alignment with the end wall structure 56 as shown in dotted lines at 57. Alternatively they could be disconnected at the other end so as to fold into alignment with the upright post 51. Once the diagonal top link 57 has been released and the toggle linkage at the foot of the post 51 has been released, the gate can be pivoted about horizontal top and bottom pivot points 58, 55 so as to lie alongside the end structure 56. The end structure can be folded down about its pivot point which may conveniently be the same pivot 55 as that of the diagonal brace 52, so as to overlie the platform 21. In an alternative (not illustrated) the end wall structure 56 may fold between the upright posts 51 leaving the latter standing.

In a still further alternative shown in chain dotted lines, the upright post 51 can be folded down separately alongside or on top of the platform 21. By the use of a loose "sloppy" pivot, it can be swung slightly outwardly to clear the sides of cargo on the platform.

It will be appreciated that various alternative forms of diagonal brace and top link can be provided within the scope of the invention. Where pivotal doors are provided, as in the FIG. 2 embodiment, a particular form of top link may be provided which does not need to be physically detached from the gates before they can be moved to the stowage condition.

Figure 9:
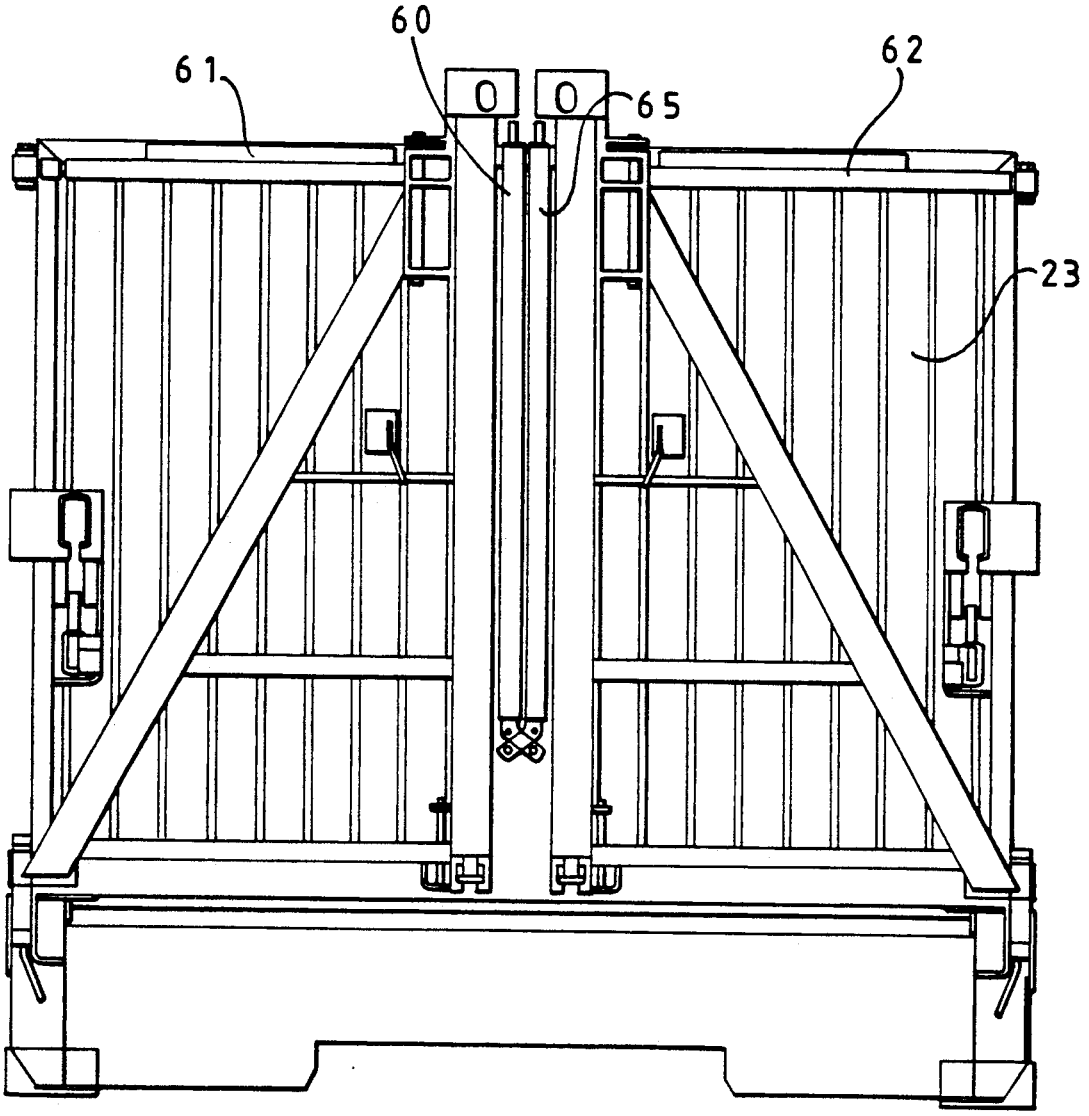
FIG. 9 is an end elevational view from the inside of a freight container similar to that of FIG. 2 with the gates folded against an end wall structure.
Figure 10:
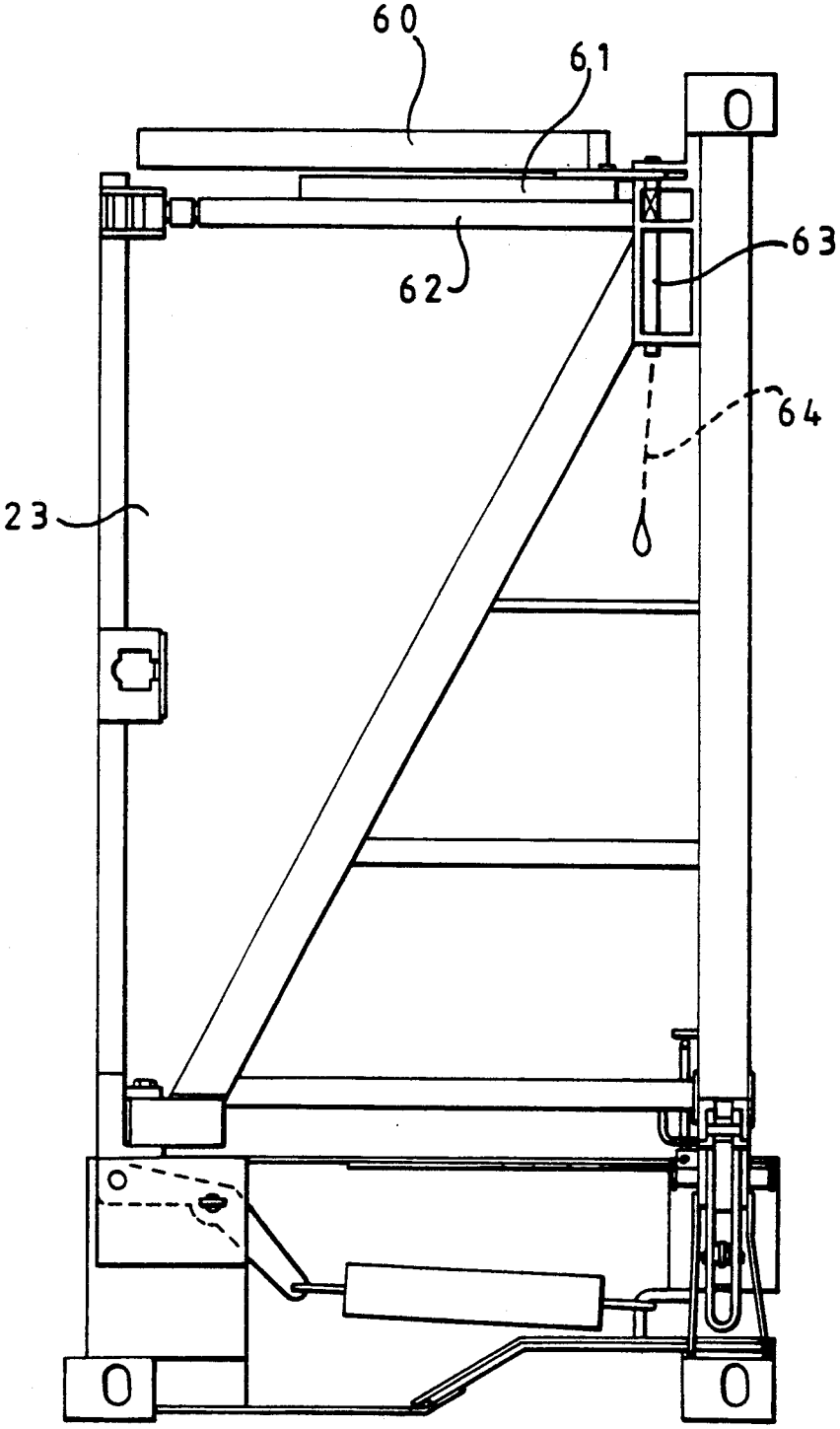
FIG. 10 is a side elevational view of the freight container of FIG. 9.
Figure 11:
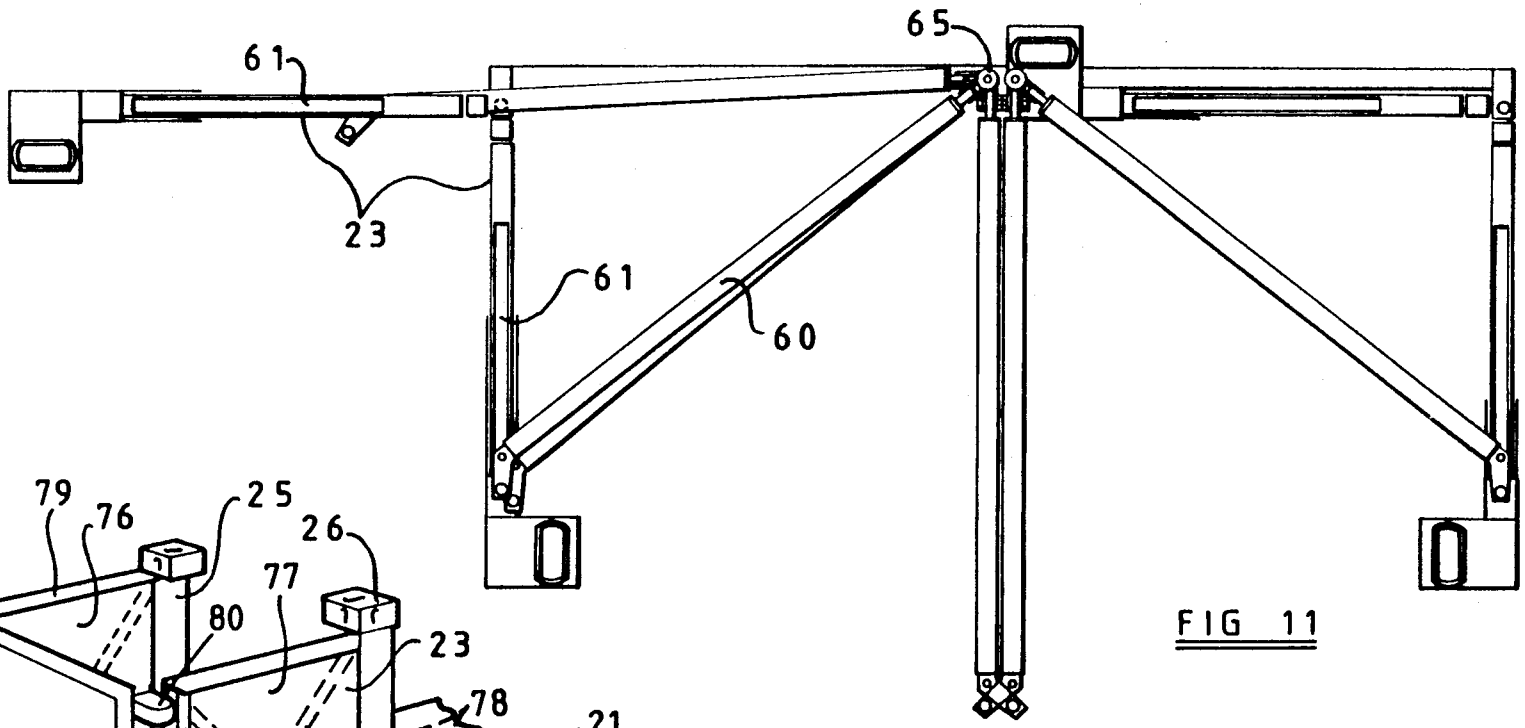
FIG. 11 is a plan view of a portion of the freight container of FIGS. 9 and 10.

This mechanism is illustrated in FIGS. 9–11 of the drawings, in which many of the parts are the same as those shown in FIGS. 2–5 and hence will not be separately referenced. The top link 60 is arranged to be movable in a track 61 running along the top edge of a horizontal member 62 of the gate. It is normally held in position at the free end of the gate adjacent the fitment 26 by a locking pin 63 which is spring loaded and which can be released by for example a pull cord 64.

The diagonal link 60 is pivoted at 65 centrally of the end wall structure 22. The gate 23 can be swung outwardly, once its foot has been released, to a position aligned with the end wall 22. This is shown in the plan view of FIG. 11. During this process, the diagonal link 60 slides along the track 61. Thus there is no danger of the operator being hurt by the link 60 dropping from its elevated position.

When the link 60 reaches the end of the track 61, it can be removed and at this point it is allowed to pivot downwardly since the pivot point 65 is in the form of a universal joint. It can be allowed to hang vertically down the inner face of the end wall structure 22. The gate 23 can be swung inwardly to the stowage condition shown in FIG. 9 with the diagonal top links 60 hanging vertically. The end wall structure can then be lowered to its stowed condition on the deck of the platform 21.

Figure 12:
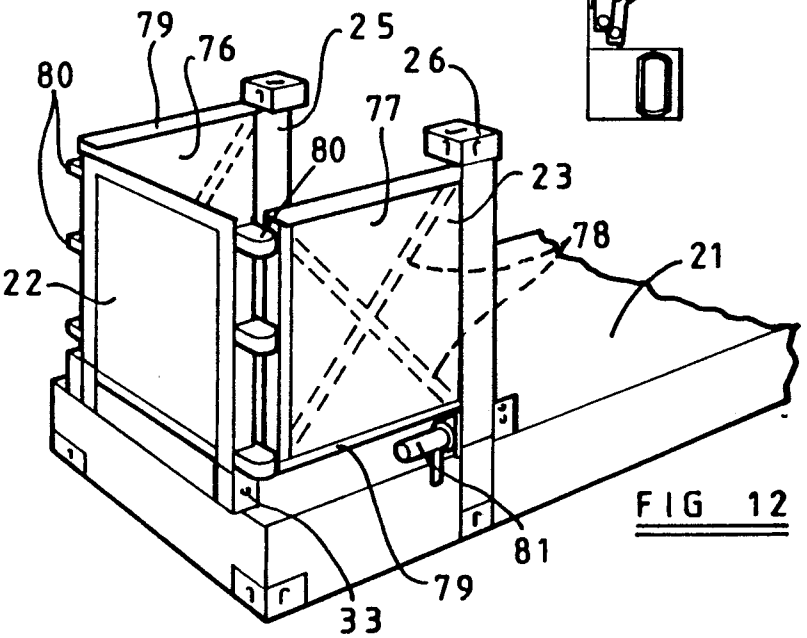
FIG. 12 is a perspective view of a further embodiment of the freight container.

In another embodiment shown in FIG. 12, the side gate 23 is made torsionally very stiff. The gate 23 (rather than the open frame construction described before) comprises a rectangular box construction formed from inner panels 76 and outer panels 77 with internal stiffeners 78, a peripheral frame 79 and a rigid post 25. The gate 23 is hinged to the end wall 22 by hinges 80. In this embodiment, there is no locking pin 34. The pivot pin 33 is positioned to take operational loads without need of a locking pin.

In operation, transverse horizontal loads acting on the top fittings 15 are supported by the gate without the need of top diagonal links 37, 57. This is achieved by the torsional stiffness of the gate 23 which is supported by hinges 80 and locking pin 81. Locking pin 81 is a simple known sliding bolt mounted either on platform 21 or gate 23 which locks gate 23 to the platform.

Longitudinal horizontal loads acting on fitting 26 are taken through the gate 23, into the hinges 80 and through the post of end wall 22, and thence to the platform 21 through hinge 33. The advantage of the hinge 33 being closely in line with the end wall is that the forces are more easily transferred to the platform. The gates 23 can swing inwards or outwards and be stowed as earlier described.

I claim:

1. A platform based freight container comprising a rectangular platform having two end portions and four corner portions;

an end structure at each of said end portions secured upright with respect to the platform in an in-use condition to define a freight-carrying space and released from the upright, in-use condition to be stowed relative to the platform in a stowed condition;

the end structure defining corner articulation means;

a pair of gates mounted in association with the end structure at said articulation means for deployment in an in-use condition in which the gates extend along the platform from the corner portions thereof;

each gate having at least one container-securing fitment at a position spaced inboard from the end of, and above the platform in said in-use condition;

and each gate being releasable from the in-use condition to a stowage condition in which they are contiguous with the end structure in its stowed condition.

2. A freight container according to claim 1 wherein the articulation means comprise upright pivots such that the gates are pivotally mounted about an upright axis with respect to the end structure in the in-use condition.

3. A container according to claim 2 wherein at least one gate is pivoted inwardly with respect to the platform to lie parallel to and within the end structure in the stowage condition.

4. A container according to claim 2 wherein at least one gate is pivoted outwardly with respect to the platform to lie parallel to and outside the end structure in the stowage condition.

5. A container according to claim 1 wherein the end structure is pivotally mounted to the end of the platform for movement to a stowed condition overlying the end of the platform.

6. A container according to claim 5 wherein further container-securing fitments are provided on the end structure at other positions spaced inboard from the end of the platform in the stowed condition of the end structure.

7. A container according to claim 1 wherein each gate is locked to the platform at a position directly below the container-securing fitment in the in-use condition.

8. A container according to claim 7 wherein each gate is locked by a manually operated toggle linkage.

9. A container according to claim 1 wherein said articulation means is provided at the foot of the end structure and the gates include a diagonal brace extending from said articulation means to said container-securing fitment.

10. A container according to claim 1 wherein the articulation means comprise horizontal pivots such that the gates are collapsible towards the end structure.

11. A container according to claim 10 wherein said articulation means is provided at the foot of the end structure and the gates include a diagonal brace extending from said articulation means to said container-securing fitment, and wherein the diagonal brace is releasable for collapsing of the gates.

12. A container according to claim 1 wherein a generally horizontal diagonal link is provided between the container securing fitment of each gate and a central portion of the end structure spaced from the nearest corner portion.

13. A container according to claim 12 wherein the diagonal link is removable.

14. A container according to claim 12 wherein the diagonal link is releasable but captive to its gate.

15. A container according to claim 12 wherein the diagonal link is captive to said central portion of the end structure at a universal joint and is slidably connected relative to its gate.

* * * * *